US005558308A

United States Patent [19]

Edris

[11] Patent Number: 5,558,308

[45] Date of Patent: Sep. 24, 1996

[54] PICNIC UTENSIL HOLD DOWN APPARATUS

[76] Inventor: Warren P. Edris, 2308 Bryant Dr., Carlsbad, Calif. 92008

[21] Appl. No.: 489,126

[22] Filed: Jun. 9, 1995

[51] Int. Cl.[6] ..... A47B 97/00

[52] U.S. Cl. ..... 248/507; 211/70.7; 248/218.4; 248/219.1; 248/219.4; 248/230.1; 248/311.2

[58] Field of Search ..... 248/37.3, 37.6, 248/230.1, 311.2, 312.1, 507, 508, 510, 218.4, 219.4, 276.1, 277.1, 309.1, 315; 211/70.7, 70

[56] References Cited

U.S. PATENT DOCUMENTS

| | | | |
|---|---|---|---|
| 151,282 | 5/1874 | Gudenoge et al. | 248/218.4 |
| D. 278,198 | 4/1985 | Harper | D7/27 |
| D. 279,521 | 7/1985 | Zucker | D3/30.1 |
| D. 307,529 | 5/1990 | Baetens | D7/505 |
| 864,968 | 9/1907 | Johnson | 248/276.1 |
| 1,975,303 | 10/1934 | Walker et al. | 248/315 |
| 2,379,206 | 6/1945 | Westlake | 248/507 |
| 2,559,739 | 9/1951 | Sherman | 211/70 |
| 3,194,403 | 7/1965 | Van Horn, Jr. | 248/315 |
| 3,533,590 | 10/1970 | Swire | 248/311 |
| 3,913,878 | 10/1975 | Wayne | 248/311.2 |
| 4,270,724 | 6/1981 | McMullen | 248/311.2 |
| 5,263,675 | 11/1993 | Roberts et al. | 248/219.4 |

*Primary Examiner*—Leslie A. Braun
*Assistant Examiner*—Richard M. Smith
*Attorney, Agent, or Firm*—David L. Baker; Rhodes & Ascolillo

[57] ABSTRACT

The invention consists of a ring that surrounds a vertical post or tube extending from a table, at least one, adapter connected to the ring and an extension arm connected to the adapter. At least three arms are rotatably connected to the extension arm proximate the adapter. One arm contains a cup holder, another arm contains arcuate recesses for securing hand utensils and another is a flat arm for holding a napkin. The extension arm contains a telescoping arm that extends with an arcuate finger to hold a plate. When brought into alignment with the extension arm the arms nest and have the capability of folding up against the vertical post.

7 Claims, 2 Drawing Sheets

PICNIC UTENSIL HOLD DOWN APPARATUS

BACKGROUND OF THE INVENTION

1. Field of the Invention

This invention relates to light weight and plastic eating utensils and in particular to an apparatus for securing utensils to a table other surface when not in the hands of the user.

2. Description of the Relevant Prior Art

The enjoyment of outdoor meals, as in patio and picnic dining, is often diminished due to the wind and even breeze effects on the utensils that form a part of the ambiance of the event. The outdoor meal is consistent with the use of paper plates and cups and plastic knives, spoons and forks, which allow the host or hostess to dispose of the tools without the inconvenience of cleaning and restacking. Most people are unaware of the capricious breezes that waft through their neighborhood until the table is set and the food is being prepared and the place settings are taken from the table and deposited on the ground or in the adjacent pool. The invention disclosed and claimed herein solves this problem in a manner in keeping with the style and atmosphere of the event.

The prior art known to the applicant in this case is restricted to U.S. Patents that are generally limited to picnic plate and cup holders which, even when combined with the entirety of common knowledge, fail to anticipate the inventive apparatus claimed herein.

U.S. Pat. No. 3,533,590 issued Oct. 13, 1970 to Swire who discloses a drinking glass holder with a clamp that will attach a food plate allowing the user to have one hand free to eat without setting the drinking-glass down.

U.S. Pat. No. Des. 278,198 issued Apr. 2, 1985 to Harper who shows a plate with a ring for a glass holder located in the surface of the plate.

U.S. Pat. No. Des. 279,521 issued Jul. 9, 1985 to Zucker who shows a detachable carrier for picnic plate, cups and accessories.

U.S. Pat. No. Des. 307,529 issued May 1, 1990 to Baetens for a combined picnic plate and cup holder that shows an annular attachment to the plate presumably for supporting a cup or drinking glass.

SUMMARY OF THE INVENTION

The invention is predicated on the fact that the table used for the meal will have a pole projecting centrally from the table surface, such as the pole supporting the umbrella on a well known and widely used style of patio table. In the alternative, a table could be conveniently modified to include a plurality of short poles projecting from a table at each place setting for the purpose of mounting the invention.

The invention is characterized by a ring that provides a means of attachment for the invention to a pole that is extending from a table surface. An adapter in the form of a hook having a bifurcated attachment means is provided to engage the invention to the ring. A single extension arm is secured in the space caused by the bifurcation and allowed to pivot about a single bolt which provides a hinge and a friction force to control the freedom of the extension to move. The flat planar surface of the extension arm which is in vertical orientation in the bifurcated space is twisted ninety degrees and is reoriented to a plane parallel with the surface of the table. The extension arm contains a telescoping arm that withdraws from the arm and forms a plate hold down tool that is adjustable dependent on the size of the table and the users' personal preference in plate location. Located in juxtaposition above the plate hold down tool is a cup holder arm which extends beyond the length of the other tools and is not adjustable. The cup holder is a ring that surrounds a portion of the body of the cup. In juxtaposition immediately below the extension arm is an eating utensil hold down tool which is shorter in length than the plate hold down tool and contains at least three adjacent arcuate recesses at the end to secure a knife, fork and spoon on the table. Another arm is located in juxtaposition with the hold down tool and is shorter than the utensil hold down tool and is a flat planar surface that is designated the napkin hold down tool. The arms are stored in a stacked condition and each contains a through going aperture near the twist point of the extension arm. A threaded bolt with a wing nut or alternatively a thumb screw passes through the apertures and terminates in the threaded aperture contained in the napkin hold down arm. The bolt controls the arms and allows the different arms to pivot about the plate hold down arm and in addition controls the friction force between the arms. The invention may be formed from any obvious material but a polymeric material is preferred.

It is therefore an object of the invention to provide a new and improved picnic utensil hold down apparatus.

It is another object of the invention to provide a new and improved picnic utensil hold down apparatus that is multi-functional and easy to use.

It is still another object of the invention to provide a new and improved picnic utensil hold down apparatus that is weather resistant.

It is still a further object of the invention to provide a new and improved picnic utensil hold down apparatus that is of a durable and reliable construction.

It is another object of the invention to provide a new and improved picnic utensil hold down apparatus which may be easily and efficiently manufactured and marketed.

It is another object of the invention to provide a new and improved picnic utensil hold down apparatus which may be used as a single unit or in multiple units.

These, together with other objects of the invention, along with the various features of novelty which characterize the invention, are pointed out with particularity in the claims annexed to and forming a part of this disclosure. For a better understanding of the invention, its operating advantages and the specific object attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
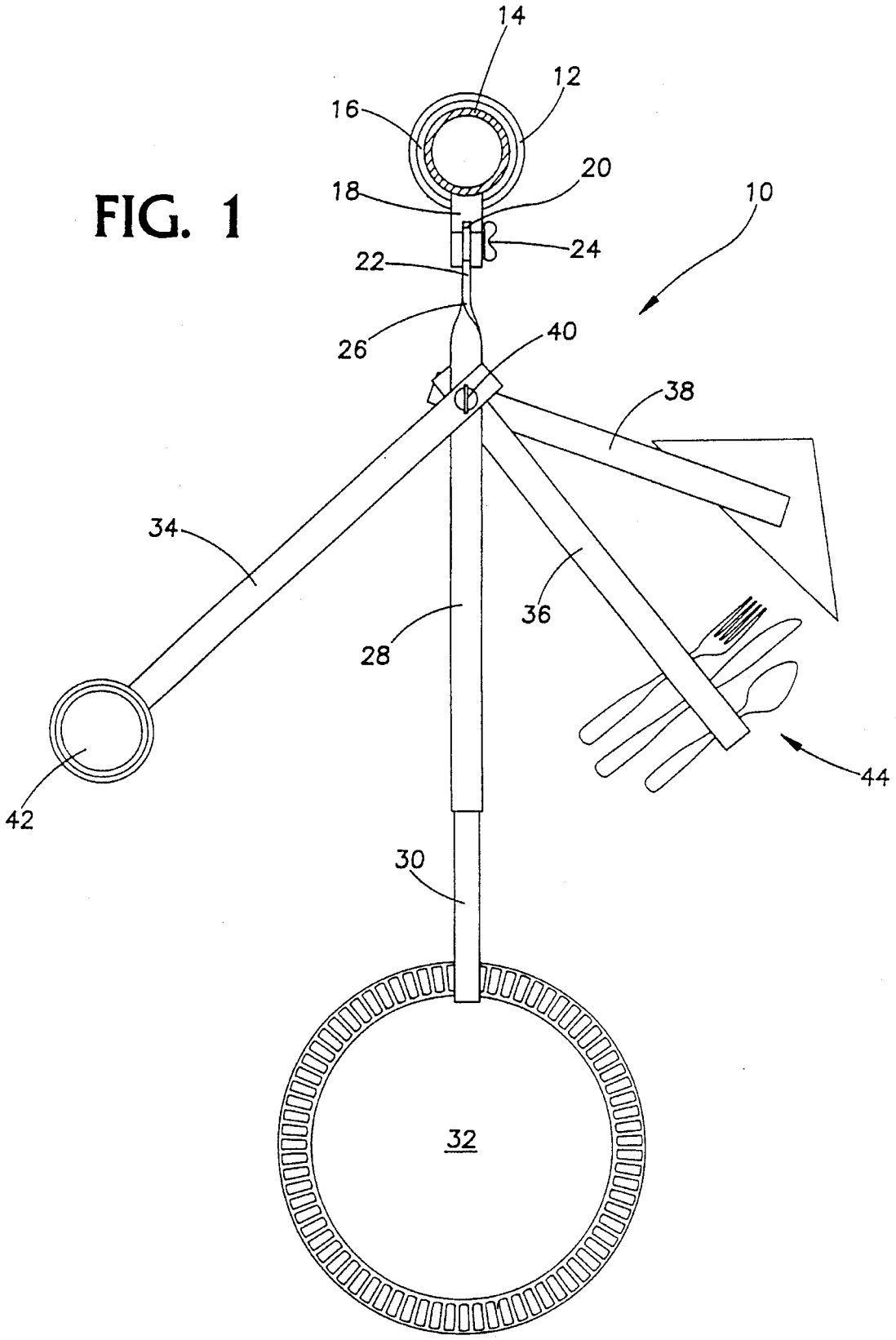
FIG. 1 is a top plan view of the invention.
Figure 2:
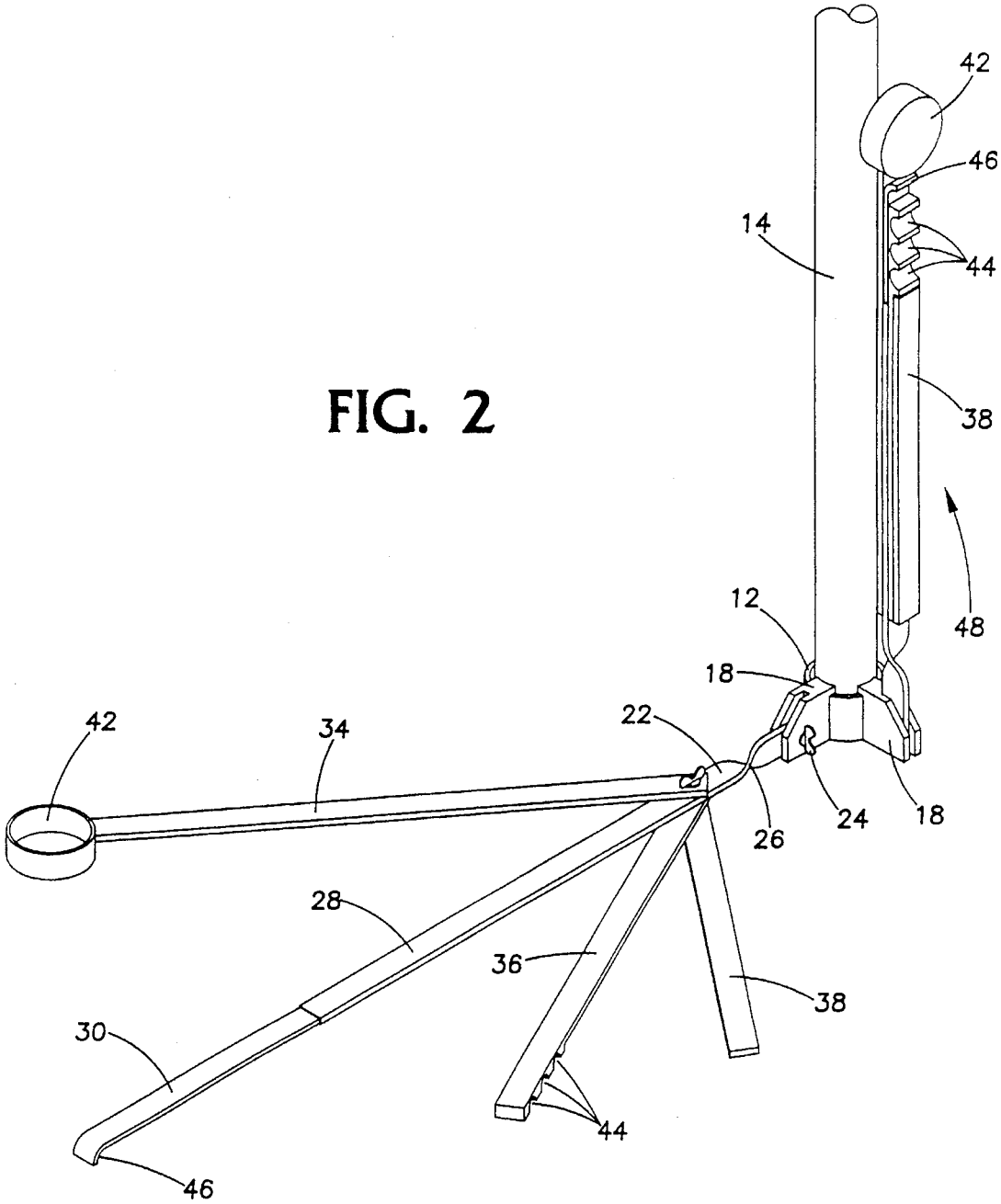
FIG. 2 is a perspective view of the invention.
Figure 3:
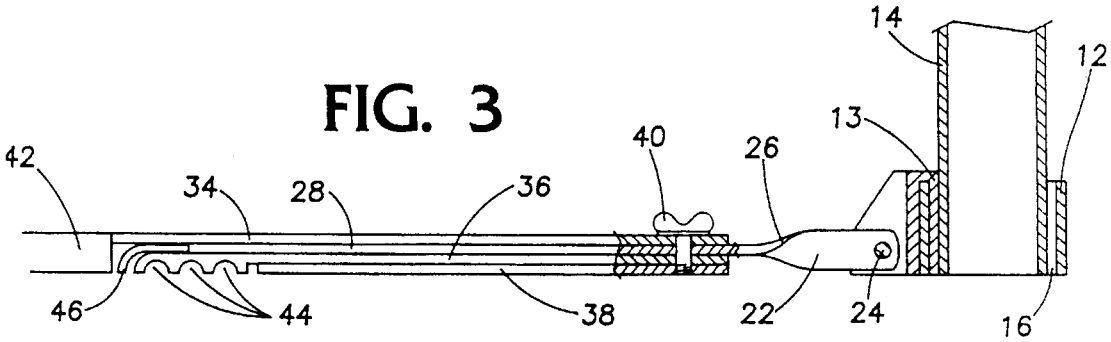
FIG. 3 is a side elevation view of the invention partly in cross section.

Referring now to FIGS. 1,2 and 3 the invention is shown generally at 10 and consists of a ring 12 surrounding a post or tube 14 with a space 16 separating the two. An adapter 18 is hooked on to the ring 12 by hook 13 which connects and secures the invention to the ring 12. One or more utensil hold down devices may be connected to each ring. The adapter 18 contains a bifurcation on the side opposed from the hook and in the recess 20 of the bifurcation an extension arm 22 is positioned and secured by a wing nut or thumb screw 24 which passes through an aperture in the extension arm and is threadedly engaged in a blind aperture in one of the bifurcated arms. The combination of the pivoting extension arm with the bifurcated arms of the adapter forms in effect a hinge which allows the extension arm to move from a position where it is co-planar with a table top to a position where it is transverse to the plane of the table top. The pressure of the wing nut or thumb screw controls the friction force applied to the extension arm. The extension arm contains a ninety degree twist at 26 causing the planar surface of the arm 28 to change from vertical to horizontal. The arm 28 contains a recess within which a telescoping member 30 is withdrawn to hold picnic plate 32 in place by means of an arcuate finger 46. Arms 34,36 and 38 are connected by wing nut or thumb screw 40 which passes through each arm and is threaded into a mating aperture in the napkin holding arm 38. Arm 34 contains a ring 42 which encircles a cup or drinking glass while arm 36 contains arcuate recesses that restrain hand utensils in the form of a knife, fork and spoon, shown generally at 44.

When not in use the invention may either be removed from the ring 12 or it may be raised against the post as shown in FIG. 2 generally at 48.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A picnic utensil hold down apparatus comprising:

a ring adapted to surround a post or tube extending vertically from a table, said ring adapted to have a diameter larger than the post or tube;

an adapter means including a hook on one side thereof for engaging the ring on one side;

an opposed side of the adapter including a pair of parallel arms and a bifurcation space where a threaded bolt means is disposed for connecting the arms;

a bifurcation on the opposed side of the adapter;

an extension arm having a vertical planar surface attached to the adapter in the bifurcation space and secured therein by the threaded bolt means and being rotatable thereabout;

a recess in the extension arm;

an arm telescopically mounted within the extension arm for holding picnic plates;

an arm pivotally mounted to the extension arm in juxtaposition above the extension arm for holding a cup and drinking glass a;

an arm pivotally mounted to the extension arm in juxtaposition below the extension arm for holding picnic utensils; and an arm for holding napkins pivotally mounted to the extension arm below the arm for holding picnic utensils.

2. A picnic utensil hold down apparatus according to claim 1 wherein a distal end of the planar surface of the extension arm is twisted ninety degrees from a proximal end of the planar surface engaged between the bifurcated arms.

3. A picnic utensil hold down apparatus according to claim 2 wherein the arm for holding picnic plates includes a distally mounted arcuate finger for holding the picnic plates.

4. A picnic utensil hold down apparatus according to claim 3 wherein the arm for holding picnic utensils includes at least three distally located, arcuately shaped recesses for holding the utensils.

5. A picnic utensil hold down apparatus according to claim 4 further including a threaded bolt engaging a proximal region of the extension arm, the arm for holding the cup and the drinking glass, the arm for holding the picnic utensils and the arm for holding the napkins and the arm for holding the picnic plates and allowing these arms to pivot about the extension arm.

6. A picnic utensil hold down apparatus according to claim 5 wherein the arm for holding the cup and the drinking glass, the arm for holding the picnic utensils and the arm for holding the napkins and the arm for holding the picnic plates nest along the primary axis of the extension arm.

7. A picnic utensil hold down apparatus according to claim 6 wherein the apparatus is formed of a polymeric material.

* * * * *